United States Patent [19]

Wikstrand

[11] 4,093,250

[45] June 6, 1978

[54] SKI POLE

[75] Inventor: Nils Wikstrand, Mora, Sweden

[73] Assignee: Firma Moon, Malung, Sweden

[21] Appl. No.: 736,850

[22] Filed: Oct. 29, 1976

[30] Foreign Application Priority Data

Oct. 30, 1975 Sweden ..... 7512169

[51] Int. Cl.[2] ..... A63C 11/24

[52] U.S. Cl. ..... 280/11.37 Z

[58] Field of Search ..... 280/11.37 N, 11.37 Z, 280/11.37 P, 11.37 B; 9/310 D, 310 A

[56] References Cited

U.S. PATENT DOCUMENTS

| | | | |
|---|---|---|---|
| 3,199,886 | 8/1965 | Dover | 280/11.37 Z |
| 3,800,734 | 4/1974 | Whang | 9/310 D |

FOREIGN PATENT DOCUMENTS

| | | | |
|---|---|---|---|
| 2,075,664 | 10/1971 | France | 280/11.37 Z |
| 2,344,449 | 3/1975 | Germany | 9/310 D |
| 2,413,204 | 10/1974 | Germany | 280/11.37 Z |
| 20,225 | 2/1909 | Norway | 280/11.37 Z |
| 14,624 | 10/1973 | Sweden | 280/11.37 Z |
| 545,635 | 2/1974 | Switzerland | 280/11.37 Z |
| 248,015 | 1/1948 | Switzerland | 280/11.37 Z |
| 608,799 | 9/1948 | United Kingdom | 280/11.37 Z |

*Primary Examiner*—David M. Mitchell

*Attorney, Agent, or Firm*—Fleit & Jacobson

[57] ABSTRACT

A ski pole of the kind having its end terminating in a shoe without a central spike, the shoe being combined with a spherically shaped cap-like member for forming a cushion of compressed snow acting as a fulcrum and bearing point for the ski pole, there being a cowl on the upper side of the shoe for preventing the collection of snow; and some kind of teeth arranged downwardly and peripherally on the shoe.

16 Claims, 4 Drawing Figures

SKI POLE

Figure 1:
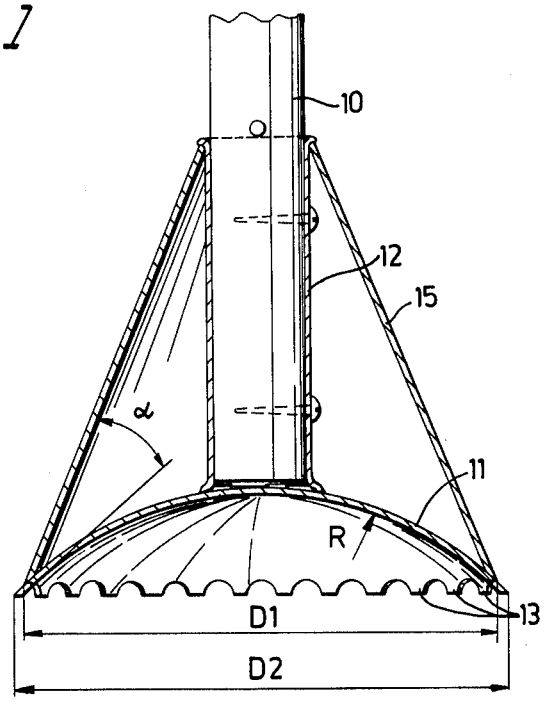

The present invention relates to a ski pole of the kind having at its end, intended for engagement with the substructure, a shoe which is provided with a snow-collecting recess facing away from the pole shaft.

Ski poles, in principle of the kind mentioned above are previously known, and are otherwise characterized in that they are furthermore provided with a central spike through the shoe, forming the termination of the pole.

In general, when using ski poles which are provided with spikes, it quite often happens that the spikes stick in the substructure, e.g. between snow-covered stones, roots and the like, or also in tightly packed snow, whereat the skier is pulled off balance, resulting in a fall and injury, not seldom with severe skeletal fractures as a result.

The known ski poles which, apart from spikes, have shoes with snow-collecting and snow-packing recesses are furthermore so wrongly designed with regard to the shape of the recess that the snow can fasten therein, and requiring increased effort for lifting the pole while skiing, and even increasing the moment of force which must be applied by the skier to turn the pole around its spike.

The main object of the present invention is thus to provide a new ski pole which completely lacks the usual central spike, and has a shoe which does not allow snow and ice to fasten in the recess, but does enable the shoe to slide for example in a similar way to a ball joint or universal joint, about a cushion of snow caught in the recess of the shoe and compressed into a shape like that of a spherical segment.

This object is achieved by the invention, which is mainly characterized in that the extremity of the pole is formed solely by the shoe, and that the recess is defined by a continuous, at least very nearly spherically cap-like sliding surface, facing the snow and ice which has been caught and collected as well as packed therein during skiing.

The invention will now be described in detail while referring to a number of embodiments schematically shown on the attached drawing, and further distinguishing features of the invention will be disclosed in conjunction herewith.

Figure 2:
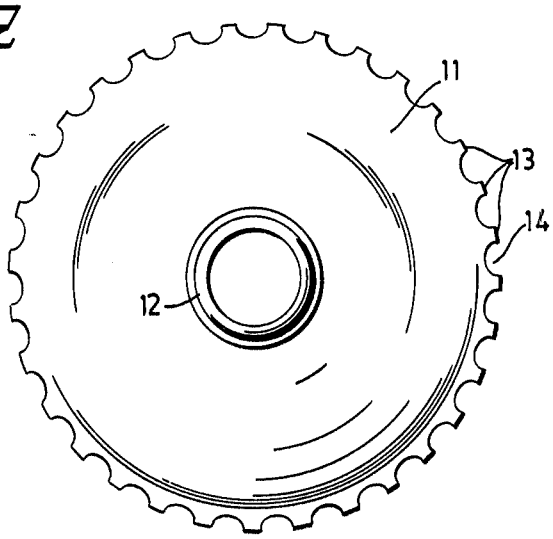
Figure 3:
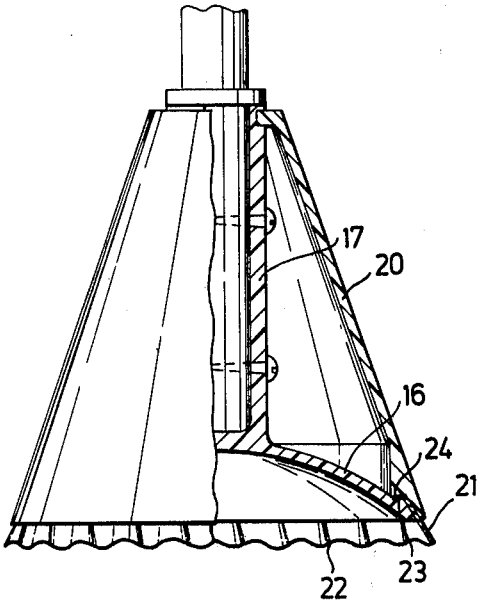
Figure 4:
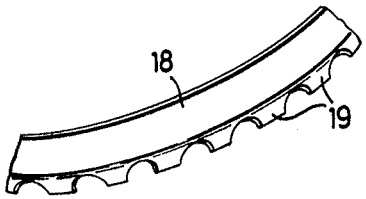

On the drawing,

FIG. 1 is a section along the central axis of the lower portion of a ski pole, provided with a shoe according to the invention and terminating the pole, FIG. 2 is an end view seen from above of the shoe in FIG. 1, FIG. 3 is a longitudinal section of a modified embodiment of FIG. 1, and FIG. 4 is a partial view of a detail in FIG. 3.

Referring now to the embodiment according to FIGS. 1 and 2, the shaft portion of a ski pole according to the invention is denoted by the numeral 10, and a shoe of suitable sheet metal, with a recess facing away from the pole, is denoted by 11, said shoe being retained on the pole 10 by means of a sheet metal ferrule 12 so that the shoe forms the sole termination of the pole. At its periphery, the shoe 11 is provided with a ring of gripping means 13 shaped as tongues or teeth, intended for engagement with the substructure and which have been cut out by the notches 14 between them in the periphery of the shoe. These gripping means replace in an advantageous way the central spike of conventional ski poles, and the recess of the shoe contributes through its snow-catching and snow-collecting properties by packing snow therein, to give the ski pole improved support against the substructure at the same time as the shape and dimensioning of the anchorage and its continuous smooth surface prevents snow from fastening therein, which would inter alia, increase the effort required by the skier to lift the ski pole.

The especially distinguishing feature of the invention subject is that the recess of the shoe 11 is defined by a continuous, at least almost spherical cap-like sliding surface, facing snow and ice which have been caught and collected, as well as packed together in the recess during skiing.

Although a shape which is a geometrically correct spherical segment is naturally to be striven for, deviations from this ideal shape come within the scope of the invention. Since the pratical production methods which may be used could compel departure from accuracy, or that the nature of the materials used requires compromises in the form of departures from the ideal shape, it is accepted that such deviations also lie within the scope of the invention, at least insofar as the subsequent alterations or variations do not substantially counteract the ability of the shoe to glide relative to the snow cushion packed in the recess. It is thus of importance that the spherical cap-shaped gliding surface of the shoe has as small a coefficient of friction as possible in respect of snow and ice in contact therewith, and that this surface therefore lacks such unevenesses, which would counteract the intended universal joint movement of the shoe on the snow collected in the recess or form places therein for retention or freezing fast of the snow or ice.

With regard to other dimensions of the shoe, the invention includes a shoe with a spherical cap-like gliding surface, the height of which is at most equal to its spherical radius.

The preferred height of the spherical cap is usually of the order of magnitude 1/5 – $\frac{2}{3}$ of the spherical radius, preferably $\frac{1}{3}$ thereof. In the practical case such radius is of the order of magnitude 40 – 70 mm, preferably 50 mm.

With regard to the diameter of the opening of the spherical cap-like surface, this is selected within the order of magnitude range 60 – 80 mm, preferably about 70 mm.

For steering away a collection of snow on the upper side of the shoe 11, said snow otherwise increasing the effort of lifting the ski pole, the upper side of the shoe is covered by a cowl in the form of a downwardly diverging, funnel-like means 15, which is attached to the pole 10 and engages against the outside of the shoe 11 close to its periphery. The details in the embodiment according to FIGS. 1 and 2 are especially suitable for production in sheet metal, e.g. light metal.

For coordinating the shoe and the funnel with each other, experience has it that the preferred magnitude at the angle $\alpha$ according to FIG. 1, between the side of the conical funnel and the tangent to the circular arc of the spherically shaped cap at the point of contact between the parts in any cutting plane coinciding with the central axis of the pole through the shoe and funnel is of the order of magnitude 20° – 30°, preferably 25°.

Particularly when the shoe and funnel are made from sheet metal, the base circle of the funnel end engaging against the shoe has a lesser diameter than that of the shoe, whereat the freely projecting peripheral outer edge of the shoe forms the gripping means for the frictional engagement of the ski pole against the substructure.

However, it is also within the scope of the invention alternatively to completely or partially construct the shoe and funnel by pressure moulding plastics or the like. A principle example of this is shown in FIG. 3, where the shoe 16 itself consists of a bowl-shaped detail, which is pressure moulded integral with a pole ferrule 17. In this example it is preferred to use a separate annular guard 18 of metal in which gripping means 19 could be cut out in the same way as the means 13 in the shoe of FIGS. 1 and 2. This annular guard is shown separately in FIG. 4 and is somewhat curved in cross-section. It is intended to be placed so that it rests against the upper side of the shoe about its periphery, to which it can be clamped fast by means of the funnel, denoted by the numeral 20 in FIG. 3, whereat said funnel can be made from sheet metal, but is preferably pressure moulded from plastics or the like.

Although the gripping means 13 and 19 described above are satisfactory per se in their gripping function, it has been found that this gripping function can be further improved if one uses, as is indicated in FIG. 3, an annular guard 21 of metal which, for example, can be corrugated in a way similar to a sine curve along the lower edge 22 by suitably stamping out the guard material.

If both the shoe and funnel are made in plastic, it is simple to provide the shoe 16 and the funnel 20 with complemental shoulders 23 and 24 respectively, and as is clearly shown in FIG. 3, to clamp the angularly bent guard 21 between both shoulders.

The invention is not limited to its shown and described embodiments, but can be varied in different ways within the scope of the following claims.

I claim:

1. In a ski pole having a pole and a snow collecting shoe attached to one end of the pole including cup means defining a recess facing away from the pole, the improvement comprising: means for attaching said cup means at an extreme end of the pole with said recess axially beneath said pole so that said recess is free from any part of said ski pole and said cup means defines a recess formed generally in the shape of a hemisphere having a substantially continuous spherical inner sliding surface, said cup means forming a gliding surface facing snow and ice compacted therein during skiing and acting as a fulcrum and bearing point for the ski pole.

2. The improvement of claim 1 wherein the height of said recess defined by said cup means is at most equal to the radius of the hemisphere.

3. The improvement of claim 1 wherein the height of said recess defined by said cup means is at least 1/5 and not more than $\frac{2}{3}$ the radius of the hemisphere.

4. The improvement of claim 1 wherein the height of said recess defined by said cup means is $\frac{1}{3}$ the radius of the hemisphere.

5. The improvement of claim 1 wherein the radius of said recess defined by said cup means is at least 40 mm and not more than 70 mm.

6. The improvement of claim 5 wherein the circumference of the bottom of said recess defined by said cup means is at least 60 mm and not more than 80 mm.

7. The improvement of claim 5 wherein the circumference of the bottom of said recess defined by said cup means is 70 mm.

8. The improvement of claim 1 wherein the radius of said recess defined by said cup means is 50 mm.

9. The improvement of claim 1, characterized in that the shoe is covered on the pole side by a cowl in the form of a conical funnel diverging away from the pole to engage against peripherally exterior portions of the hemispherical cup means.

10. The improvement as claimed in claim 9, characterized in that the angle ($\alpha$) between the side of the conical funnel and the tangent to the circular arc of the recess defined by said cup means at the point of contact between the parts in any cutting plane, coinciding with the central axis of the pole, through the shoe and the conical funnel is at least 20° and not more than 30°.

11. The improvement of claim 9 wherein the circumference of the portion of the funnel engaging the shoe is less than the circumference of a bottom of the cup means, said bottom forming gripping means engageable with ice and snow.

12. The improvement of claim 11 wherein said gripping means comprises a plurality of notches formed in the bottom of the shoe.

13. The improvement of claim 11 wherein said gripping means comprises a downwardly extending corrugated surface.

14. The improvement of claim 9 further including a ring having a top and a bottom, said bottom comprising a plurality of notches, the ring being positioned with said top between said funnel and said shoe.

15. The improvement of claim 14 wherein the ring is a coating on the external surface of said cup means.

16. The improvement as claimed in claim 9, characterized in that the angle $\alpha$ between the side of the conical funnel and the tangent to the circular arc of the recess defined by said cup means at the point of contact between the parts in any cutting plane, coinciding with the central axis of the pole, through the shoe and the conical funnel is 25°.

* * * * *